US005568661A

United States Patent [19]

Bathrick et al.

[11] Patent Number: 5,568,661

[45] Date of Patent: Oct. 29, 1996

[54] ARTICULATED BED WITH FRAME MOUNTED POWER MODULE

[75] Inventors: Leeland M. Bathrick, Crystal Lake, Ill.; Michael W. Chizek, Racine, Wis.; Glenn Brittain, McHenry, Ill.

[73] Assignee: C.E.B. Enterprises, Inc., Mundelein, Ill.

[21] Appl. No.: 308,412

[22] Filed: Sep. 19, 1994

[51] Int. Cl.[6] ..... A47B 7/02

[52] U.S. Cl. ..... 5/618; 5/285; 5/616

[58] Field of Search ..... 5/613, 616, 617, 5/618, 670, 285

[56] References Cited

U.S. PATENT DOCUMENTS

| | | | |
|---|---|---|---|
| 2,297,105 | 9/1942 | Laukhuff | 5/618 |
| 2,337,284 | 12/1943 | Urie | 5/618 |
| 3,300,794 | 1/1967 | Altorfer . | |
| 3,349,877 | 10/1967 | Downs | 5/618 |
| 4,120,057 | 10/1978 | Neumann . | |
| 4,381,571 | 5/1983 | Elliott | 5/620 |
| 4,675,926 | 6/1987 | Lindblom | 5/618 |

FOREIGN PATENT DOCUMENTS

| | | | |
|---|---|---|---|
| 2651978 | 3/1991 | France | 5/618 |
| 642359 | 7/1962 | Italy | 5/618 |

*Primary Examiner*—Flemming Saether

[57] ABSTRACT

An articulated bed having a modified standard bed frame that supports an independent power module, replaceable without disassembly from the frame. The modified frame is the well known horizontally collapsible angle iron frame type with castered legs. The frame includes a pair of side rails each having head and foot rail portions pivotally connected at their ends for packing and shipping, that interengaged one another when assembled in the home. The modification in the frame is that the side rails are inverted and the legs are somewhat lengthened to accommodate the power module. After the frame is assembled in the home, a pair of "U" shaped cross members is attached across the frame and the power module fixed to the tops of the cross members. Then a folded for shipping mattress support assembly is unfolded and attached to the top of the frame over the power module.

10 Claims, 3 Drawing Sheets

ARTICULATED BED WITH FRAME MOUNTED POWER MODULE

BACKGROUND OF THE INVENTION

Articulated beds having only recently achieved significant commercial success in the residential market and previously such beds have been marketed for the most part as a hospital or nursing home product and with such objectives have been over designed and overly complicated and as a result have been too costly for the residential or home market.

Over the last several decades articulated chairs and sofas have achieved some commercial success in the residential market but only recently has such technology been adapted for the residential articulated bed marketplace.

A primary consideration in the design of articulated beds and components therefore in the residential market is ease of shipment because a container the size of an entire assembled articulated bed would not only be excessively large but too heavy for a single delivery person to bring into the home to install.

One attempt at solving this problem is illustrated in the Elliott U.S. Pat. No. 4,381,571 which shows an articulated mattress spring that is adapted to fit on top of and rest on a separate simple rectangular bed frame. The Elliott mattress frame includes large stationary "L" shaped side sections with cross members to provide support for axially oriented motor and screw assemblies that drive complicated four bar linkages at the four corners of the module that serve to raise and lower the head and leg sections of the mattress support. While Elliott suggests that these parts, numbering literally hundreds, may be disassembled for shipment it is realistically not practical to have the purchaser reassemble this complex device in his or her home.

A similar articulated bed is illustrated in the Neumann U.S. Pat. No. 4,120,057 and it shows a power system for an articulated mattress support and, like the Elliott design, is adapted to fit into a bed frame. The problem with the Neumann device is that it requires a large rectangular frame the size of the bed frame itself so that no size reduction is practically possible in the Neumann system.

Furthermore in the Elliott device the power module with drive motors, gearing and rocker shafts, requires that the rocker shafts be mounted in outboard bearings, i.e. bearings in the large rectangular frame described above and such outboard bearings denigrate the capability of shipping the bed in easily carried containers without requiring any significant reassembly at the purchaser's location.

Other articulated beds are illustrated in the Muir U.S. Pat. No. 1,397,773 and the Szemplack, et al. U.S. Pat. No. 3,051,965. The patent to Muir also shows a device for adjusting the articulated bed. Double motor-type systems are shown in the Taylor U.S. Pat. No. 2,500,742. Another standard articulated bed frame is illustrated in Hanning, et al. U.S. Pat. No. 3,921,230.

In our prior U.S. Pat. No. 5,063,623 we disclose a power module for an articulated bed assembly that fits into a completely standard bed frame. A mattress support is provided that has wooden planar panels hinged to one another with a stationary central section adapted to be bolted to the top of the standard bed frame, a pivotal head section, and pivotally interconnected thigh and foot sections. The power module has an elongated housing that supports separate electric drive motors, one for the head section and one for the thigh and foot sections. Drive gearing in the module transmits power from the motors to transversely mounted rocker shafts that have rocker arms at the ends thereof that respectively pivot the head and leg sections upwardly and downwardly with a suitable wand-type control that reversely controls the two moters.

In our prior patent, the power module was connected to the underside of the central stationary section of the mattress support.

It is the primary object of the present invention to provide an improved articulated bed assembly that utilizes the power module, somewhat modified, disclosed in our prior patent.

SUMMARY OF THE PRESENT INVENTION

In accordance with the present invention an articulated bed having a modified standard bed frame is provided that supports an independent power module replaceable without disassembly from the frame. The modified frame is of the well known horizontally collapsible angle iron-type with castered legs. The framing includes a pair of side rails each having head and foot rail portions pivotally connected thereto at their ends for packing and shipping, that interengage one another when assembled in the home.

The modifications in the frame are the provisions of inverted side rails so that the horizontally flat parts of the angle irons are at the top, and its legs are somewhat lengthened to accommodate the underslung power module. After the frame is assembled in the home, a pair of "U" shaped cross members are attached across the frame and the power module is affixed to the tops of these cross members.

This design has many of the advantages of the power module and standard bed frame disclosed in our prior patent referred to above.

Toward these ends, a mattress support is provided that has wooden planar panels hinged to one another with a stationary central section, a pivotal head section and pivotally interconnected thigh and foot sections. The power module has an elongated housing that supports separate electric drive motors, one for the head section and one for the thigh and foot sections, and drive gearing that transmits power from the motors to transversely mounted rocker shafts that have rocker arms at the ends thereof that respectively pivot the head and leg sections upwardly and downwardly with a suitable wand switch that reversely controls the two motors.

An important aspect of the present invention is the housing for the drive module provides the sole pivotal support for these two rocker shafts. As noted above these rocker shafts have previously been journalled inside frame members that require the drive module and the side frame members to be shipped as a unit from the manufacturing location to assembly location or from assembly to ultimate purchaser, because frequently the receiving party cannot technically provide the proper assembly. With the present module final set up is reduced and the power module can be shipped in a much smaller container in its completely assembled form.

Another advantage in this power module is that it can be removed as a unit from the frame cross member for repair or replacement.

This unitary power module, i.e. the elongated housing containing the two drive motors, the two rocker shafts, the rocker arms and interconnecting gearing, offers the manufacturer a variety of marketing options without requiring disassembly of the power module. One option is the power module manufacturer can ship the power module fully assembled to the articulated bed manufacturer, frequently skilled in wood working and to a limited extent welding, but not skilled in power drive systems. Such bed manufacturers would construct the wood planar mattress support and simply attach the power module to the cross frame member. No other interconnections would be required to complete the power module and frame assembly in operative cooperation. The articulated bed manufacturer then sells this completed assembly as a unit.

The advantage of the present articulated invention over that shown in our prior patent, is that the present design is an entire bed assembly that can be packaged for shipment to the ultimate user in three compact packages, one including the power module, one including the collapsed modified bed frame and "U" shaped cross members, and the final one containing the collapsed mattress support.

These three packages can be sent either directly to the consumer's home or can be shipped to distributors or to retail bedding operations.

Other objects and advantages of the present invention will appear more clearly from the following detailed description.

DETAILED DESCRIPTION OF THE PREFERRED EMBODIMENTS

Figure 1:
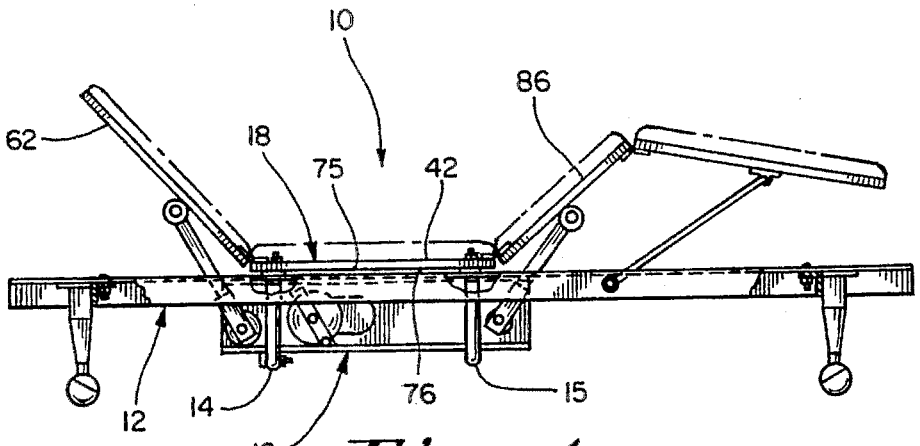
FIG. 1 is a left side view of a bed assembly according to the present invention.
Figure 2:
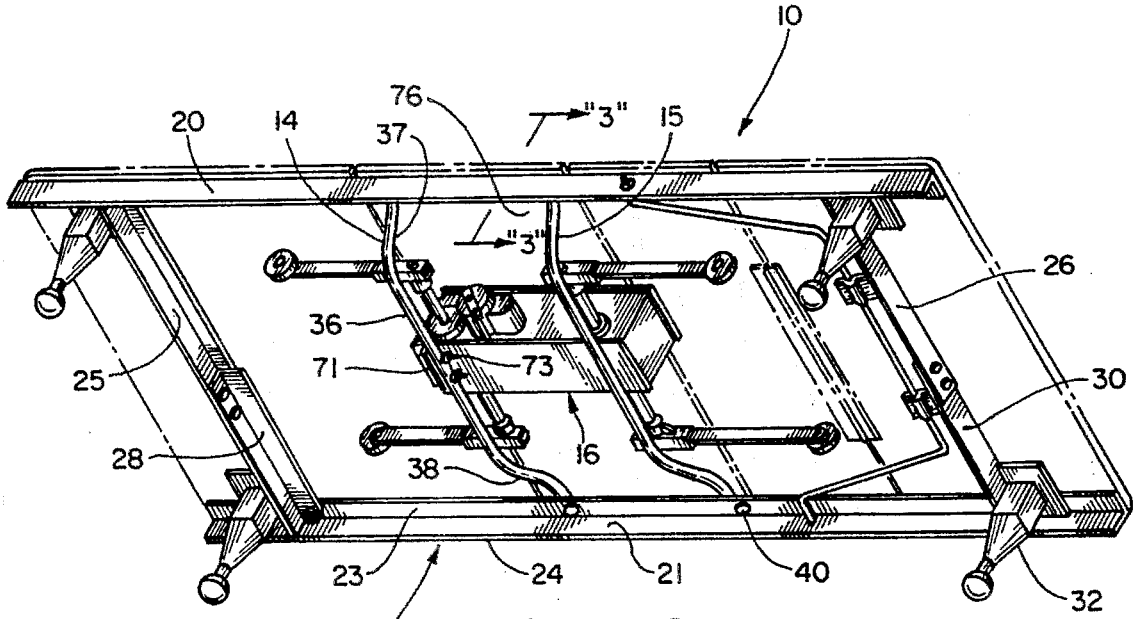
FIG. 2 is a perspective bottom view of the articulated bed assembly illustrated in FIG. 1.

Referring to the drawings and particularly FIGS. 1 and 2, an improved articulated bed assembly 10 is illustrated according to the present invention and is seen to include a modified horizontally collapsible standard bed frame 10, a pair of "U" shaped cross members 14 and 15 that support a power module 16 in a central slung position beneath an articulated panel mattress support 18.

As seen more clearly in FIG. 2, the bed frame assembly 12 is similar to the standard mattress and box spring drop-in frame assemblies except that the rails are inverted to support the mattress support assembly 18 which lies flushed to the top of the frame assembly 12. Frame assembly 12 is collapsible in its own horizontal plane for packing and shipping in the same manner as a standard drop-in frame commercial available for many years.

Figure 3:
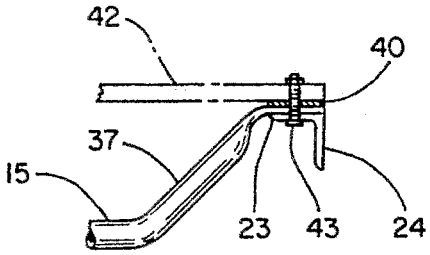
FIG. 3 is a fragmentary section of one of the bed side rails taken generally along line 3—3 of FIG. 2.

Bed frame assembly 12 includes angle iron side rails 20 and 21 having horizontal leg portions 23 and vertical leg portions 24 as seen clearly in FIGS. 2 and 3.

The side rail 20 has a head rail portion 25 pivotally connected thereto at one end and a foot rail portion 26 pivotally thereto at its other end. And similarly the other side rail 21 has a head rail portion 28 connected at its head end and a foot rail portion 30 pivotally connected thereto at its foot end. The head rail portions 25 and 28 and the foot rail portions 26 and 30 can be pivoted to positions coaxially with the side rails 20 and 21 for packing and shipment. Four leg and caster assemblies 32 are provided one welded at each end of the side rails 20 and 21 as shown. The leg assemblies 32 are somewhat longer than standard to accommodate the slung position of the power module assembly 16 and the cross members 14 and 15 as seen more clearly in FIG. 1.

The cross members 14 and 15 are practically identical, each including a straight central section 36 upon which the power pack 16 rests and upwardly reversely curved end portions 37 and 38 that terminate in flat end flanges 40. As shown more clearly in FIG. 3, the cross rails 14 and 15 are tubular ;and the flanged ends 40 are formed simply by flattening the tubular ends out. Continuing viewing FIG. 3, the flattened ends 40 are sandwiched between side rail flange portion 23 and mattress support fixed central panel 42 by threaded fasteners 43, four of which are required for complete assembly.

With this design, the cross frame members 14 and 15 can be connected to the side rails 20 and 21 at the same time and with the same fasteners as the mattress support 18.

Figures 4, 5, 6:
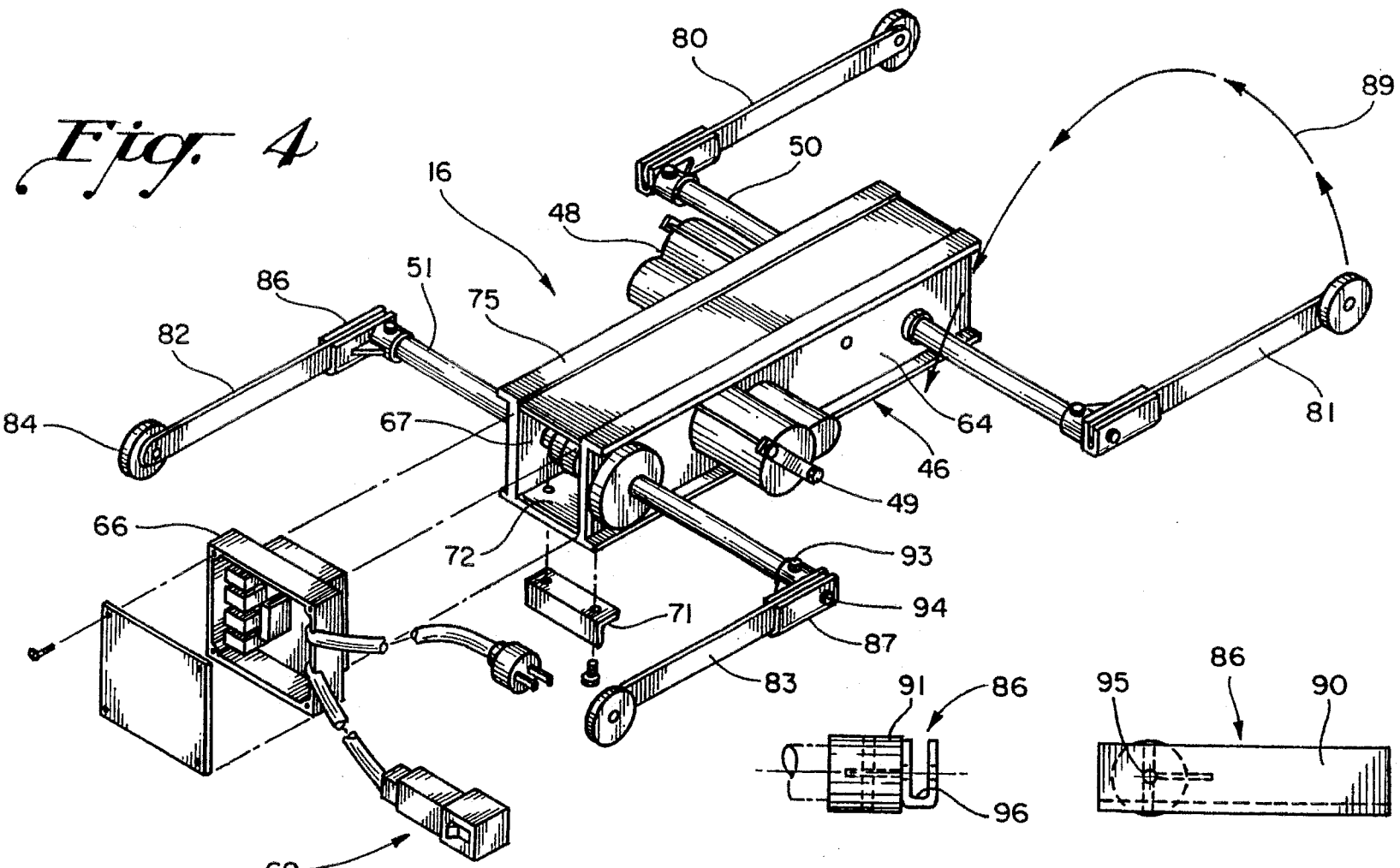
FIG. 4 is a partly exploded enlarged perspective of the power module assembly illustrated in FIGS. 1 and 2.
FIG. 5 is a sub-assembly end view of a channel fitting assembly that limits pivotal movement of one of the rocker arms.
FIG. 6 is a sub-assembly side view of the channel fitting assembly shown in FIG. 5.
Figure 7:
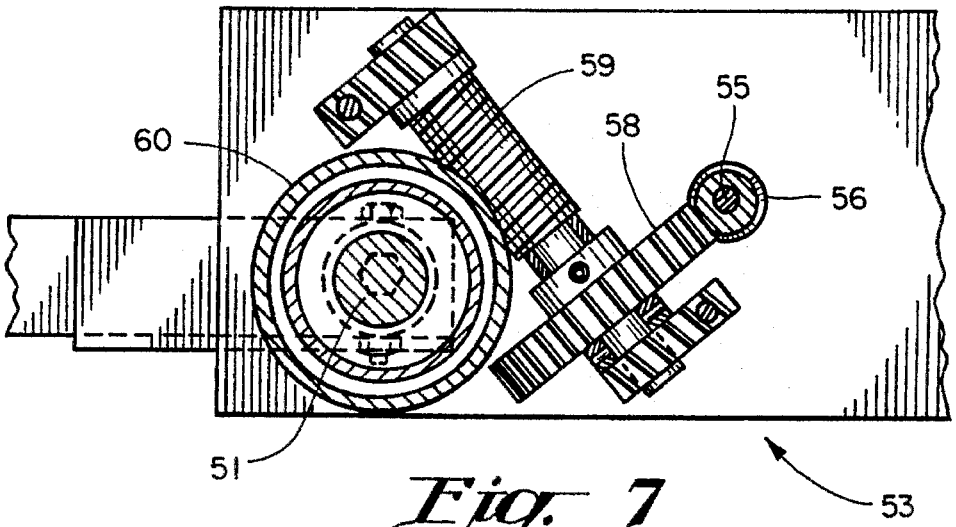
FIG. 7 is a right side view of the gearing for one of the rocker shafts in the power module illustrated in FIGS. 1, 2 and 4.
Figure 8:
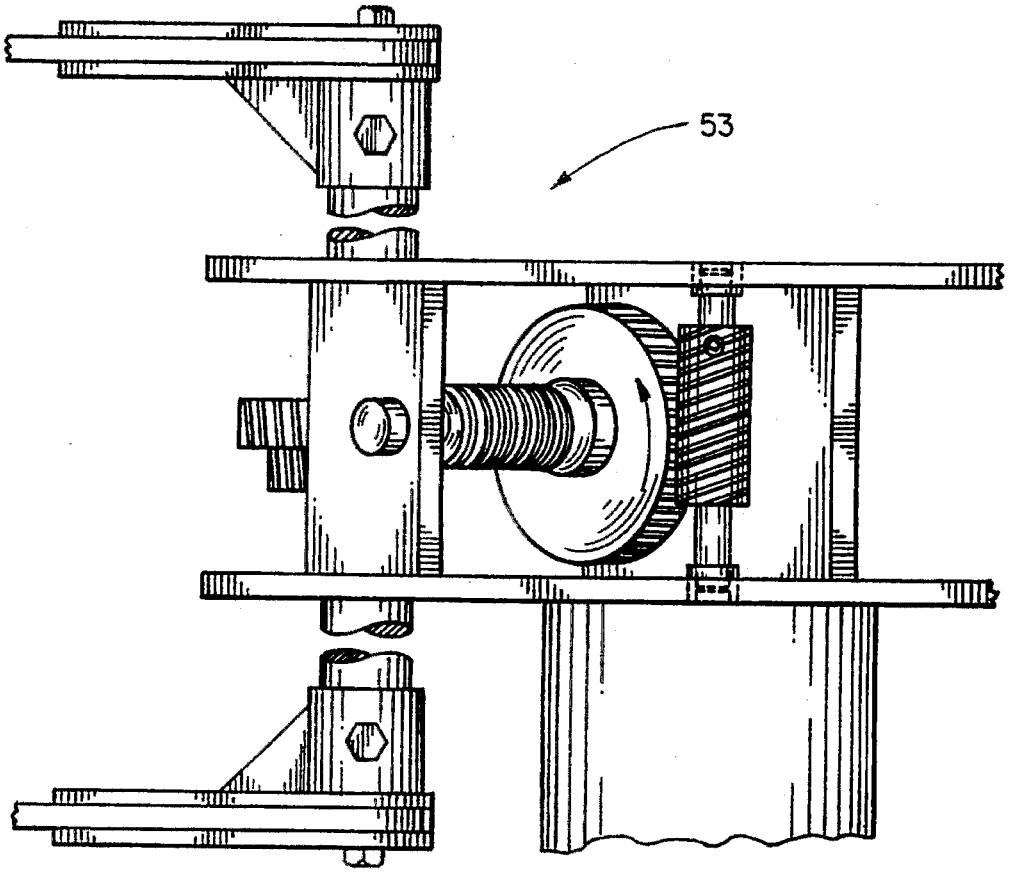
FIG. 8 is a top view of the gearing and rocker shaft illustrated in FIG. 7.

As seen more clearly in FIG. 4, the power module 16 has a generally rectangular elongated extruded or die cast aluminum housing 46 the side walls of which support motor drive assemblies 48 and 49 which respectively pivot rocker shafts 50 and 51 journalled at opposite ends of the housing 46 through the gearing illustrated in FIGS. 7 and 8 with the understanding that one set of this gearing is provided for each of the motors 48 and 49.

As noted the gearing assembly 53 illustrated in FIGS. 7 and 8 is identical for both motors although the one illustrated in these figs. is in connection with the forward rocker shaft 51.

As seen in FIGS. 7 and 8, a motor out-put shaft 55 carries a worm gear 56 that interengages with a worm wheel 58 that is shafted with another worm gear 59 that interengages with a worm wheel 60 fixed to rocker shaft 51. This double reduction gearing provides a gearing 53 with a high reduction characteristic on the order of 3600 to 1 rpm reduction between motor out-put shaft 55 and rocker shaft 51, bearing in mind that rocker shaft 51 oscillates less than a quarter of a revolution in moving head mattress support panel 62 from its horizontal position to its fully upright position illustrated approximately in FIG. 1, and similar parameters are utilized for the rear or leg rocker shaft 50.

An important aspect of the present invention is that the rocker shafts 50 and 51 are rotatably supported in bearings carries by housing side walls 64 and no other out-board means of support are provided for these rocker shafts. Thus, the power module 16 may be shipped as a unit either to a bed distributor or to the ultimate user without requiring any assembly to outer frame commonly thought necessary in the prior art.

Motors 48 and 49 are controlled by a control system 66 that encloses a forward opening 67 in the housing and has a remote wand assembly 69 that has separate switches for reversely controlling the motors 48 and 49.

As seen in FIGS. 2 and 4, an angle bracket 71 is fixed to power module housing wall 72 by suitable fasteners and this bracket as seen in FIG. 2 is fastened by fasteners 73 to the central portion 36 of the cross frame member 14. Housing 46 rests on both of the tops of the frame members 14 and 15 but is fixed to only the frame member 14. Alternatively bracket 14 could be die cast with the housing as one-piece construction.

Another important aspect to the present invention is "U" shaped frame members 14 and 15 are curved sufficiently so that housing top wall 75 as seen in FIG. 1 is co-planar with lower surface 76 of mattress support central panel 42. In this way the power module housing 46 and obviously the cross frame members 14 and 15 support the central area of the fixed mattress support panel 42 so that is it supported not only along side rails 20 and 21 but centrally.

As seen in FIG. 4, the rocker shafts 50 and 51 are provided with rocker arm assemblies 80, 81, 82 and 83 each of which has a nylon roller 84 at its outer end that rollingly engage the mattress support head panel 62 and through panel 86 as shown in FIG. 1.

The rocker arms 80, 81, 82 and 83 are fastened to the ends of the rocker shafts 50 and 51 by a pair of mirror image channel fitting assemblies 86 and 87 with fitting 86 being shown as a sub-assembly in FIGS. 5 and 6. Fittings 86 and 87 permit the rocker shafts to be pivotally folded in the direction of arrows 89 shown in FIG. 4 toward the opposite rocker shaft for shipment. That is, rocker arms 80 and 81 pivot to rocker shaft 51 and rocker shafts 82 and 83 pivot toward rocker shaft 50. The rocker arms are sufficiently long compared to the space in between shafts 50 and 51 so the ends of the rocker arms when collapsed will hit the opposite rocker shaft or opposite fittings 86 and 87. But there is enough play in the fittings 86 and 87 to accommodate this collapsing movement even though rocker arm 80 is generally co-planar with rocker arm 82 and rocker arm 81 is generally co-planar with rocker arm 83.

To accommodate this collapsing movement of this rocker arms 80 to 83, the channel fitting assemblies 86 and 87(which as noted are mirror images of one another) have an upwardly opening channel portion 90 welded to cylindrical boss 91 that is fixed to the end of the rocker shaft by a fastener 93. The end of each of the rocker arms has an aperture which receives pivot pin 94 that extends through aperture 95 in the channel. In this way the fittings 86 and 87 are fixed to the ends of the rocker shafts and the rocker arms can pivot upwardly from their positions shown in FIG. 4 but cannot pivot downwardly because of engagement with the channel bottom 96 in the channel portion 90.

The present bed frame 12 can be collapsed and packaged with the shorter cross frame members 14 and 15 in a relatively small but elongated container. The power module 16 with the rocker arms 80 to 83 in their collapsed position can be packaged in a second container no longer than the length of the power module housing 46 including the small additional length of the control box 66. A third container packages the mattress support 18 in a fully collapsed position having a length and width no greater than the collapsed size of the support.

We claim:

1. An articulated bed with a frame mounted replaceable power module, comprising: a general rectangular bed frame having side rails and legs to support the frame above the floor, the upper surface of the frame lying in a reference plane, an articulated mattress support mounted on the frame having at least one pivotally mounted panel, said mattress support being coplanar with the reference plane in a retracted position thereof, said mattress support including a plurality of removable panels support and directly engaging the upper surface of the frame, a removable cross frame connected to the frame side rails, an independent power module having a drive housing releasably connected to the cross frame and extending completely below the reference plane, at least one rocker shaft extending outwardly from the housing and supported by the housing without any direct connection to the side rails and without being supported on cross members connected to the side rails, and a rocker arm driven by the rocker shaft for pivoting the pivotally mounted mattress panel, whereby the cross frame can be easily installed on the side rails and the power module can be easily attached to the cross frame.

2. An articulated bed with a frame mounted replaceable power module as defined in claim 1, wherein the power module has two rocker shafts each having at least one rocker arm connected thereto, said mattress support including at least two pivotally mounted panels each one pivoted by one of the rocker arms.

3. An articulated bed with a frame mounted replaceable power module as defined in claim 1, including means for collapsing the rocker arm toward the housing for packing and shipping without removing the rocker arm from the end of the rocker shaft.

4. An articulated bed with a frame mounted replaceable power module as defined in claim 3, wherein the means for collapsing the rocker arm includes means for pivotally mounting the rocker arm to the end of the rocker shaft.

5. An articulated bed with a frame mounted replaceable power module, comprising: a general rectangular bed frame having side rails and legs to support the frame above the floor, the upper surface of the frame lying in a reference plane, an articulated mattress support mounted on the frame having at least one pivotally mounted panel, a removable cross frame connected to the frame side rails, an independent power module having a drive housing releasably connected to the cross frame and extending completely below the reference plane, at least one rocker shaft extending outwardly from the housing and supported by the housing without any direct connection to the side rails, and a rocker arm driven by the rocker shaft for pivoting the pivotally mounted mattress panel, whereby the cross frame can be easily installed on the side rails and the power module can be easily attached to the cross frame, said cross frame including two parallel generally "U" shaped frame members that carry the power module housing below the reference plane.

6. An articulated bed with a frame mounted replaceable power module as defined in claim 5, wherein the power module is generally rectangular and elongated and is mounted on the top of the "U" shaped frame members.

7. An articulated bed with a frame mounted replaceable power module, comprising: a generally rectangular bed frame having side rails and legs to support the frame above a floor, the upper surface of the frame lying in a reference plane, an articulated mattress support mounted on the frame having at least two pivotally mounted mattress panels, said mattress support being coplanar with the reference plane in a retracted position thereof, said panels being removably supported on and directly engaging the upper surface of the frame, a removable cross frame connected to the frame side rails, and an independent power module having a drive housing releasably connected to the cross frame and extending completely below the reference plane, the power module having two rocker shafts each having at least one rocker arm connected thereto, said rocker shafts being solely supported by the housing without any support on cross members connected to the side rails, each of said mattress panels being pivoted by one of the rocker arms, whereby the cross frame can be easily installed on the side rails and the power module can be easily attached to the cross frame.

8. An articulated bed with a frame mounted replaceable power module, comprising: a generally rectangular bed frame having side rails and legs to support the frame above a floor, the upper surface of the frame lying in a reference plan, an articulated mattress support mounted on the frame having at least two pivotally mounted mattress panels, a removable cross frame connected to the frame side rails, and an independent power module having a drive housing releasably connected to the cross frame and extending completely below the reference plane, the power module having two rocker shafts each having at least one rocker arm connected thereto, each of said mattress panels being pivoted by one of the rocker arms, whereby the cross frame can be easily installed on the side rails and the power module can be easily attached to the cross frame, said power module being generally rectangular and elongated and being mounted on the top of "U" shaped frame members.

9. An articulated bed with a frame mounted replaceable power module, comprising: a generally rectangular bed frame having side rails and legs to support the frame above a floor, the upper surface of the frame lying in a reference plane, an articulated mattress support mounted on the frame having at least two pivotally mounted mattress panels, a removable cross frame connected to the frame side rails, and an independent power module having a drive housing releasably connected to the cross frame and extending completely below the reference plane, the power module having two rocker shafts each having at least one rocker arm connected thereto, each of said mattress panels being pivoted by one of the rocker arms, whereby the cross frame can be easily installed on the side rails and the power module can be easily attached to the cross frame, the cross frame including two parallel generally "U" shaped frame members that carry the power module housing below the reference plane, said power module being generally rectangular and elongated and is mounted on the top of the "U" shaped frame members.

10. An articulated bed with a frame mounted replaceable power module, comprising: a generally rectangular bed frame having side rails and legs to support the frame above a floor, the upper surface of the frame lying in a reference plane, an articulated mattress support mounted on the frame having at least two pivotally mounted mattress panels, a removable cross frame connected to the frame side rail, and an independent power module having a drive housing releasably connected to the cross frame and extending completely below the reference plane, the power module having two rocker shafts each having at least one rocker arm connected thereto, each of said mattress panels being pivoted by one of the rocker arms, whereby the cross frame can be easily installed on the side rails and the power module can be easily attached to the cross frame, means for collapsing the rocker arms toward the housing for packing and shipping without removing the rocker arms from the end of the rocker shafts, said means for collapsing the rocker arms including a channel fixed to the end of the rocker shafts with said rocker arms being pivotally mounted in the channel so the channel limits pivotal movement of the rocker arms with respect to the rocker shafts.

* * * * *